United States Patent [19]

Luehring

[11] Patent Number: 4,568,804

[45] Date of Patent: Feb. 4, 1986

[54] HIGH VOLTAGE VACUUM TYPE CIRCUIT INTERRUPTER

[75] Inventor: Elmer L. Luehring, Cleveland Heights, Ohio

[73] Assignee: Joslyn Mfg. and Supply Co., Chicago, Ill.

[21] Appl. No.: 529,393

[22] Filed: Sep. 6, 1983

[51] Int. Cl.[4] ..... H01H 33/66

[52] U.S. Cl. ..... 200/144 B; 200/144 R; 200/83 R; 200/308; 200/238; 174/50.52; 29/874; 29/842; 29/622; 29/450; 313/238

[58] Field of Search ..... 200/144 B

[56] References Cited

U.S. PATENT DOCUMENTS

| | | | |
|---|---|---|---|
| 3,025,375 | 3/1962 | Frank | 200/144 B |
| 3,159,731 | 12/1964 | Luehring | 200/144 B |
| 3,275,775 | 9/1966 | Hawkins | 200/144 B |
| 3,426,168 | 2/1969 | Hansen | 200/144 B |
| 3,471,669 | 10/1969 | Curtis | 200/144 B |
| 3,562,457 | 2/1971 | Peek | 200/144 B |
| 4,256,938 | 3/1981 | Efinger | 200/144 B |

FOREIGN PATENT DOCUMENTS

| | | | |
|---|---|---|---|
| 1229619 | 12/1966 | Fed. Rep. of Germany | 200/144 B |

*Primary Examiner*—Robert S. Macon

*Attorney, Agent, or Firm*—Mason, Kolehmainen, Rathburn & Wyss

[57] ABSTRACT

A high voltage vacuum-type circuit interrupter is disclosed that includes a single or one-piece ceramic insulating housing providing both the external solid insulation between a line terminal and a switch terminal and the external solid insulation between the line terminal and electrical ground. The ceramic housing is mounted on a metallic base by the wedging action of a spring disposed under tension on an exterior inclined surface at the lower longitudinal end of the insulating housing and on an interior inclined surface of the base. A solenoid operated toggle mechanism disposed in the base actuates an elongated operating rod that effectuates the opening and closing of a pair of switch contacts positioned in an evacuated ceramic casing that includes a relatively shallow recess formed about its internal periphery intermediate its longitudinal ends. A tubular metallic vapor shield is held in the ceramic casing by a plurality of metallic ring segments positioned in the recess. Radially outwardly protuberant portions formed in the shield both above and below the ring segments secure the shield to the ring segments. The switch and the line terminals are formed as flattened longitudinal ends of elongated conductive tubular members. A flexible pressure equalization diaphragm is formed in situ in the base and is secured therein and is movable to equalize pressure. A visually discernible position indicator, located within the base, provides a visual indication of the "OPEN" position or "CLOSED" position of the switch contacts. The contacting portion of each switch contact is disposed within an elongated, tubular contact stem and is brazed substantially flush with the end of the stem; subsequently, a portion of the stem at that end is removed to reduce the possibility of the welding together of the contacting portions of the switch contacts.

22 Claims, 28 Drawing Figures

Fig. 1
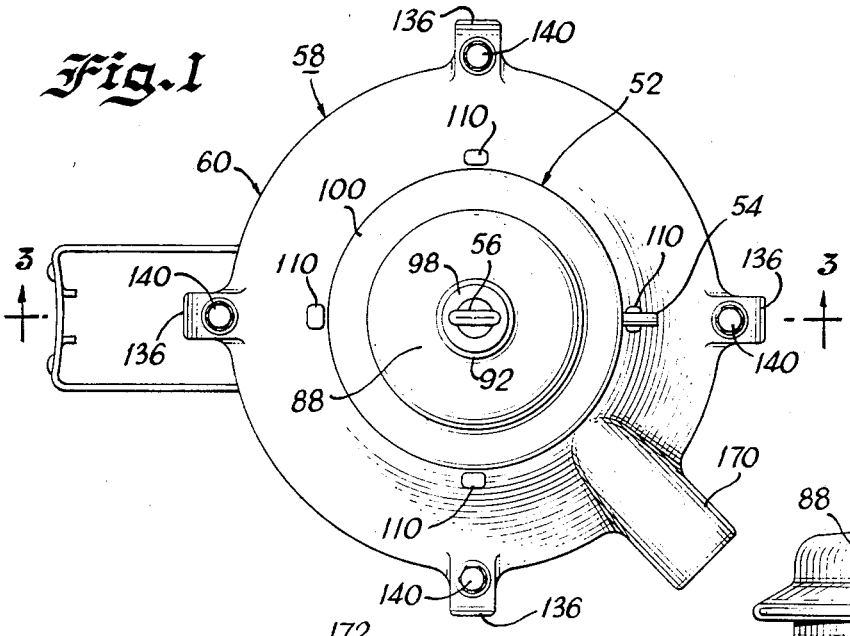
Fig. 5
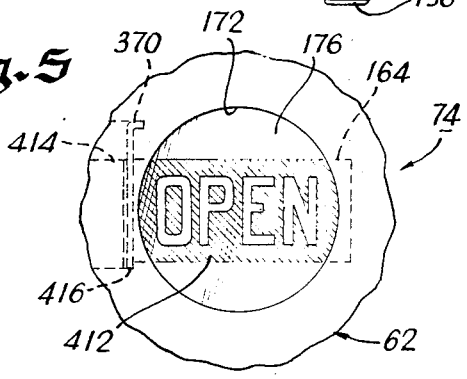
Fig. 6
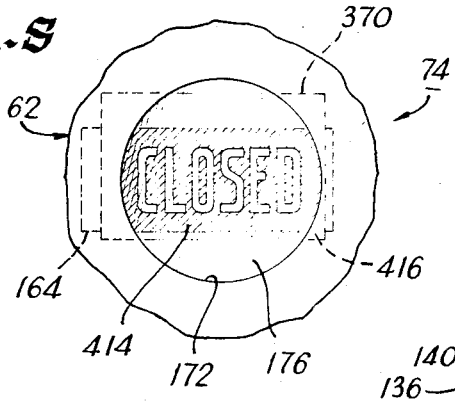
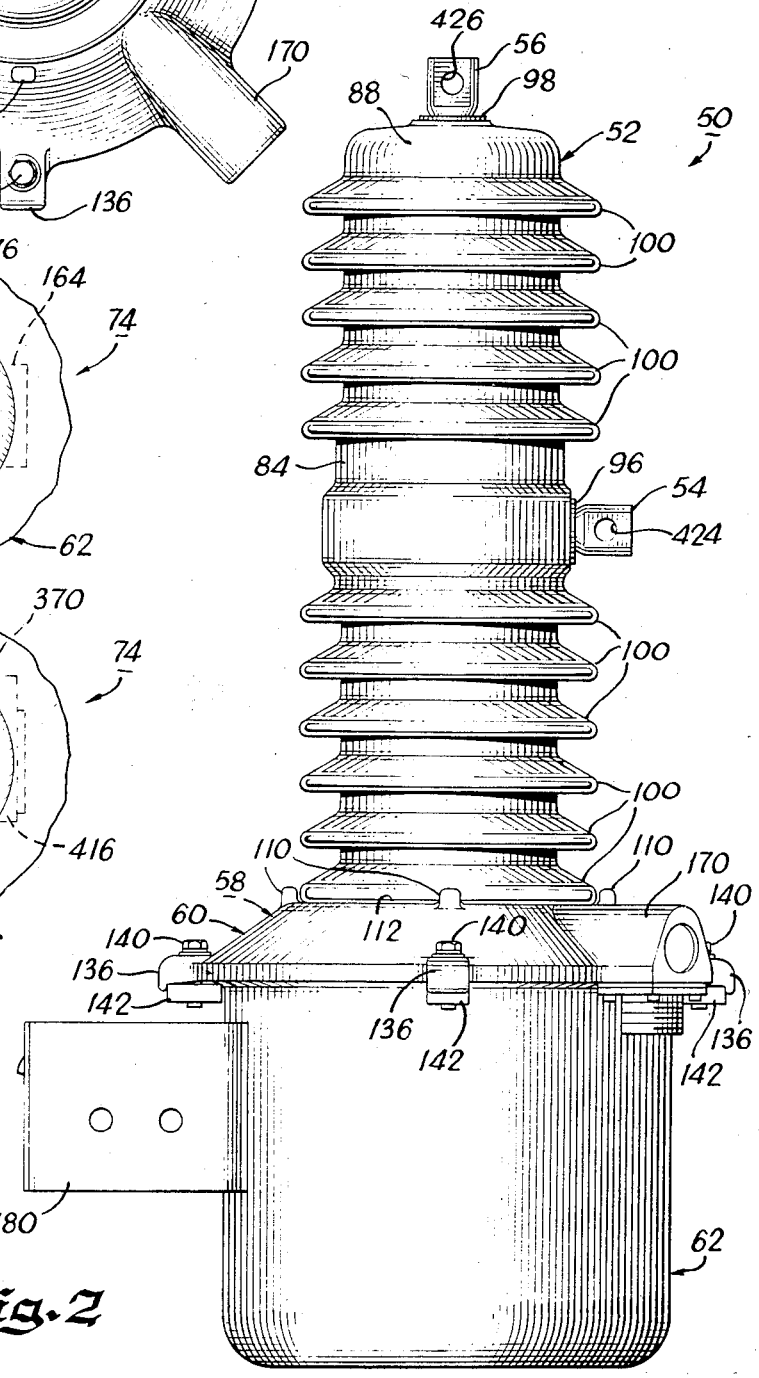
Fig. 2

Fig. 4
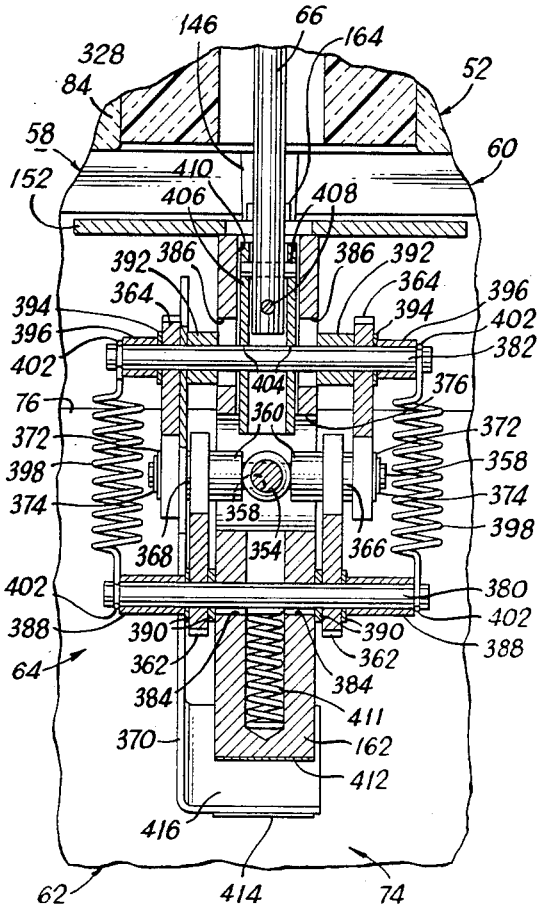
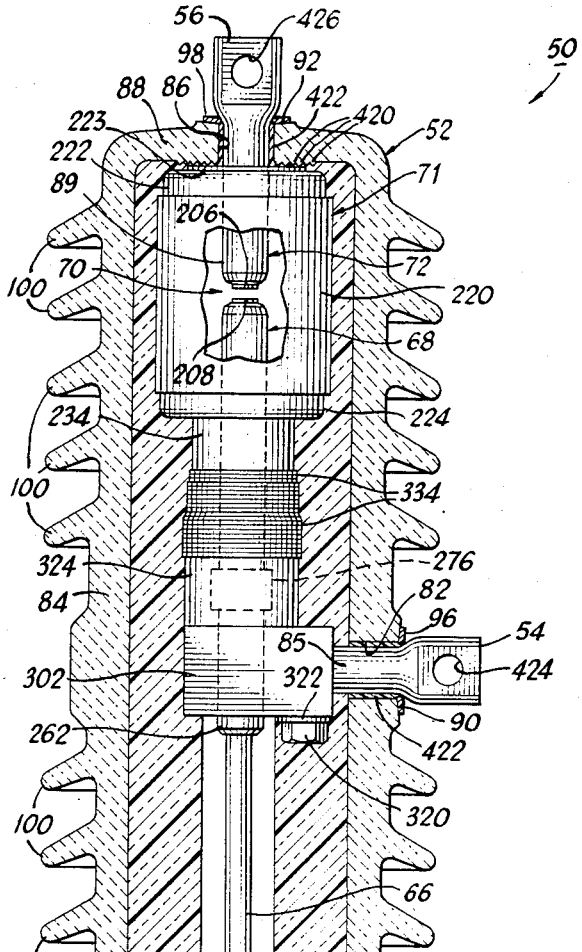
Fig. 3

Fig. 7
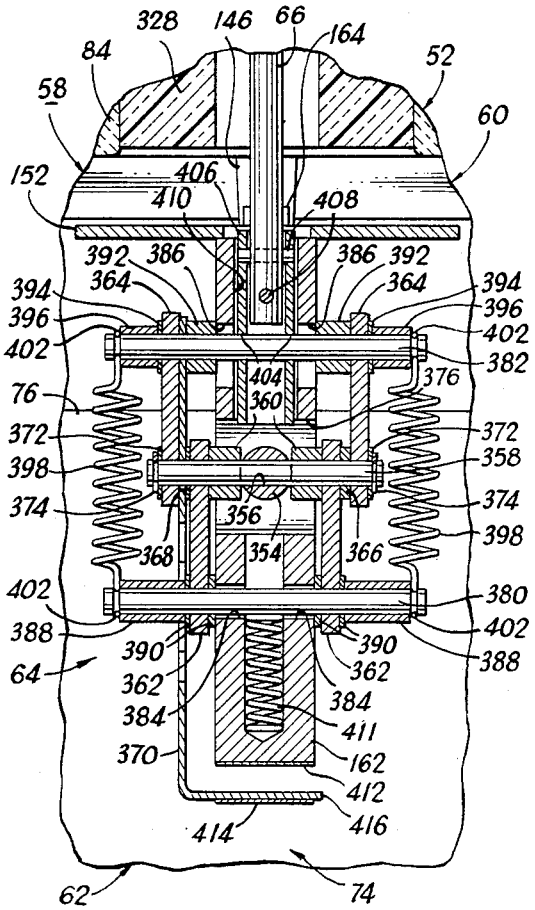
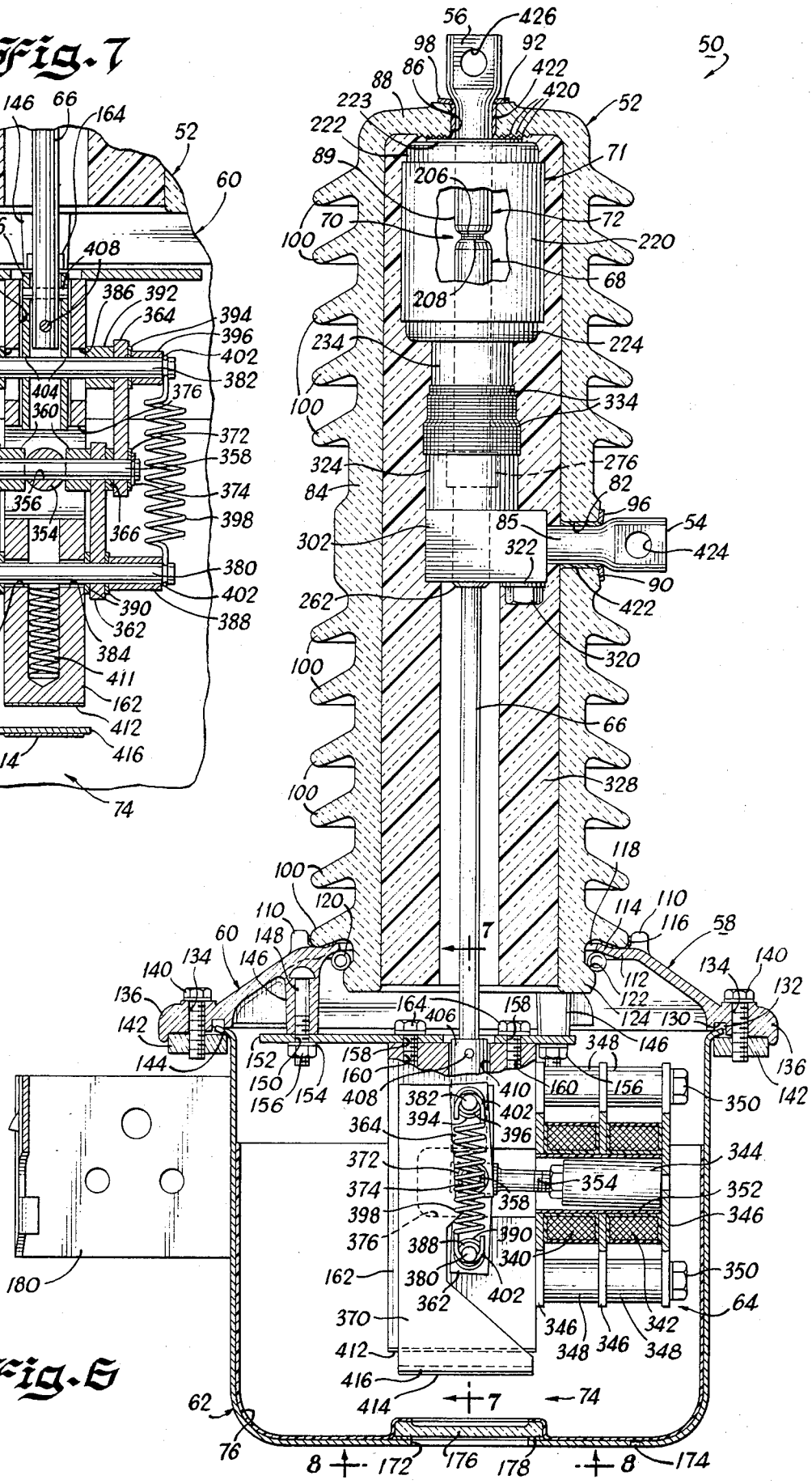
Fig. 6

Fig. 14
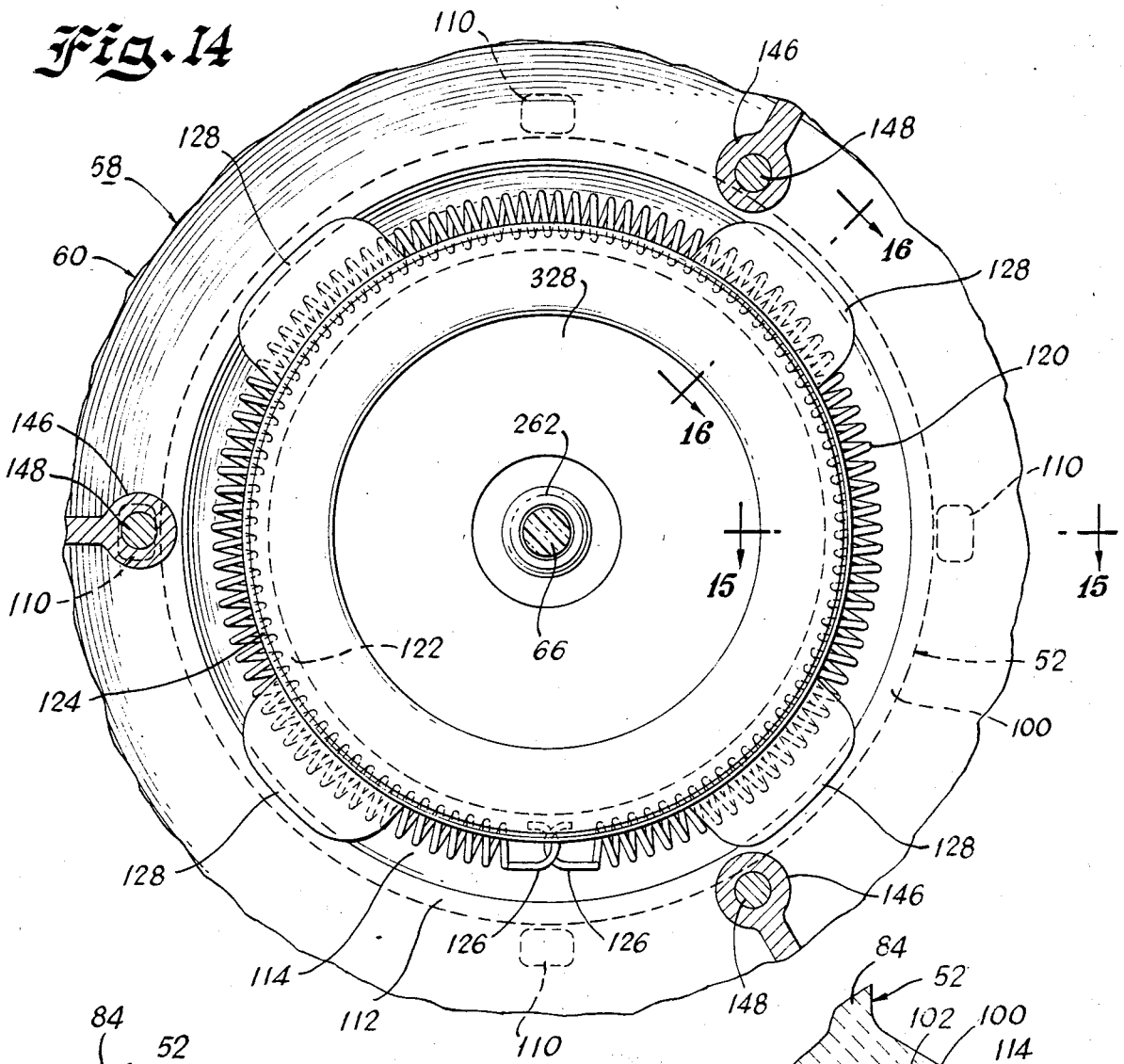
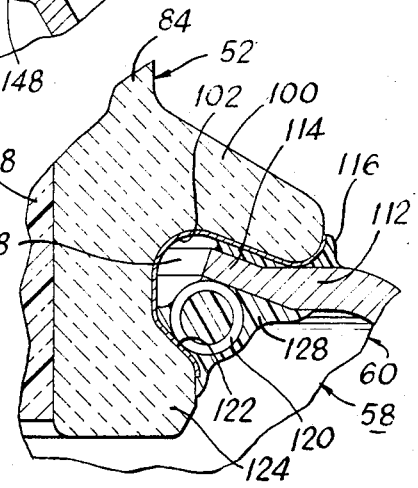
Fig. 16
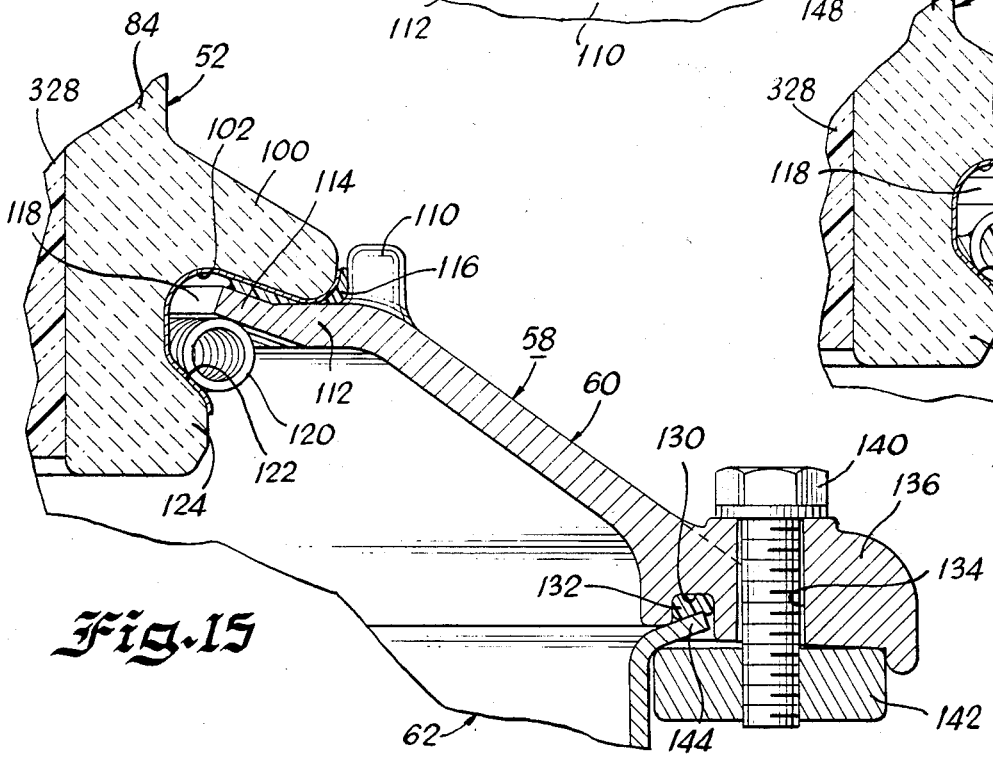
Fig. 15

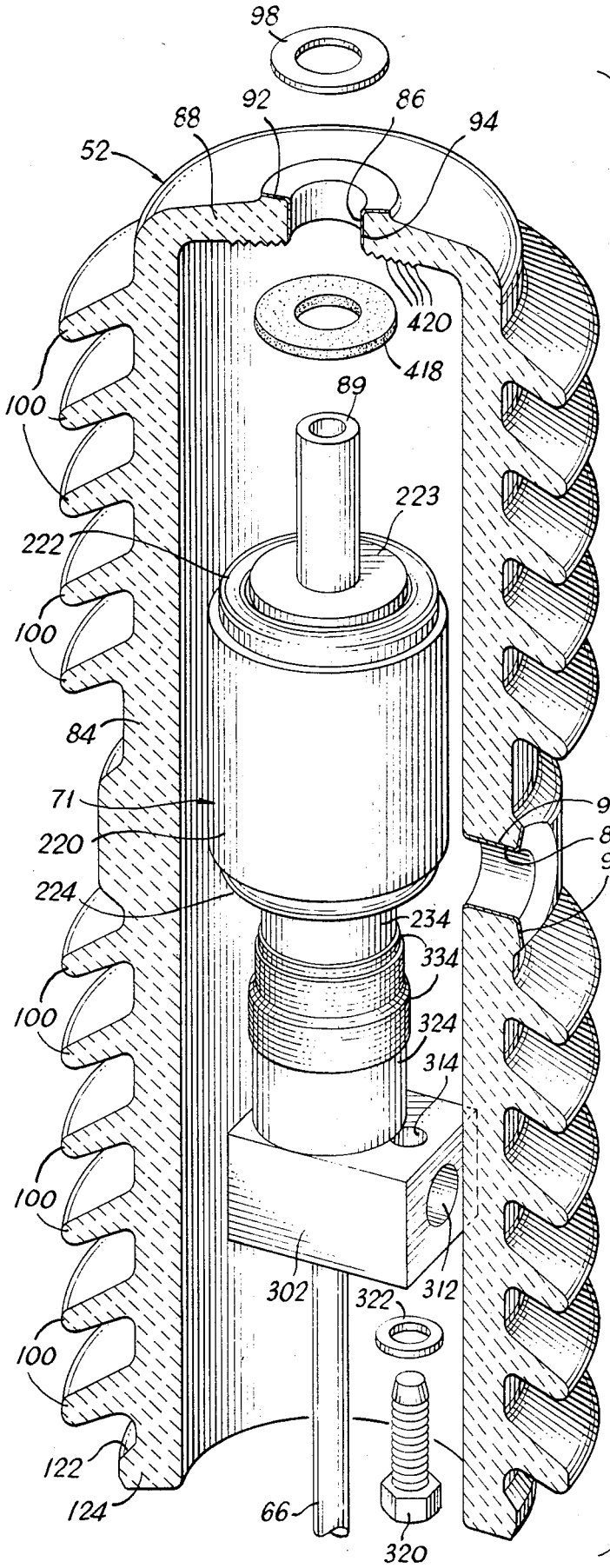
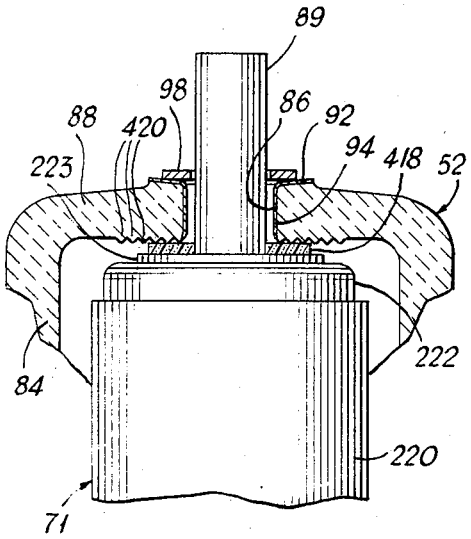
Fig. 18
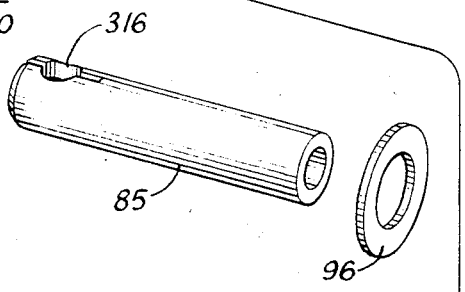
Fig. 17

144
62
76
174
178
190
188
22
176
172
184
180

HIGH VOLTAGE VACUUM TYPE CIRCUIT INTERRUPTER

BACKGROUND OF THE INVENTION

A. Field of the Invention

This invention relates generally to high voltage circuit breakers for interrupting the flow of electrical current in high voltage electrical circuits and, more particularly, to a new and improved high voltage vacuum-type circuit interrupter. As used herein, the term "high voltage" means a voltage greater than one thousand volts.

B. Description of the Prior Art

Electrical circuit breakers and, more specifically, high voltage vacuum-type circuit interrupters, are old and well known in the art. A representative example of such a circuit interrupter, as disclosed and depicted in U.S. Letters Pat. No. 4,343,030, utilizes a plurality of two, separated, transversely disposed, insulating housings to perform the function of separating a line terminal from a switch terminal. Generally speaking, high voltage vacuum-type circuit interrupters and the individual components thereof have had many varied, generally complex and expensive configurations and have been produced in accordance with generally complicated and expensive methods of manufacture and assembly. For example, illustrative methods and structures for supporting generally tubular metallic shields of vacuum-type circuit interrupters are disclosed in U.S. Letters Pat. Nos. 3,048,681; 3,048,682; 3,586,801; 3,777,089; and 4,158,911. Switch contacts for vacuum-type circuit interrupters have also been provided having an electrical contact brazed to a solid or tubular elongated stem, the outer periphery of the contact generally extending beyond the outer periphery of the stem. Furthermore, many methods have been utilized to prevent internal components of high voltage electrical devices from being damaged or destroyed due to the ingress of moisture or other environmental contaminants. For example, separately formed elastomeric or rubber diaphragms, bellows or bladders have been installed in electrical equipment to equalize the pressure within the equipment with that of the surrounding environment. Finally, as depicted in U.S. Letters Pat. No. 2,981,813, it is known to utilize a single evacuated enclosure of a vacuum switch or relay to form both the solid external electrical insulation between coaxially aligned first and second electrical terminals both disposed at one longitudinal end of the enclosure and the solid external electrical insulation between the first and second terminals and a metallic base or support for the vacuum device at its other longitudinal end.

The present invention relates to improvements in high voltage vacuum-type circuit interrupters and in their internal components and in their methods of manufacture and assembly.

SUMMARY OF THE INVENTION

An object of the present invention is to provide a new and improved electrical circuit breaker.

Another object of the present invention is to provide a new and improved high voltage vacuum-type circuit interrupter.

Another object of the present invention is to provide new and improved internal components for high voltage vacuum-type circuit interrupters and for other electrical equipment.

Another object of the present invention is to provide new and improved methods of manufacture and assembly for high voltage vacuum-type circuit interrupters and for their internal components.

Another object of the present invention is to provide a new and improved high voltage vacuum-type circuit interrupter having a single or one-piece ceramic insulating housing that forms both the external solid insulation between the line terminal and the switch terminal of the circuit interrupter and the external solid insulation between the line terminal and electrical ground.

Another object of the present invention is to provide a new and improved method and structure for supporting a generally tubular, metallic member, such as a vapor shield within a tubular ceramic enclosure, such as an-insulating enclosure of a vacuum module used in a high voltage vacuum-type circuit interrupter.

Another object of the present invention is to provide an improved structure and method of forming the switch contacts of a high voltage vacuum-type circuit interrupter.

Another object of the present invention is to provide a new and improved structure and method of forming in situ a pressure equalization diaphragm to prevent the ingress of moisture and other environmental contaminants capable of causing damage or destruction to the internal components of electrical equipment.

Another object of the present invention is to provide a new and improved structure and method of mounting a switch contact and of forming electrical terminals for high voltage electrical equipment.

Another object of the present invention is to provide a new and improved method for assembling or mounting an insulating housing on a metallic support structure.

Another object of the present invention is to provide a new and improved structure and method for visually indicating the switched condition of switch contacts in a high voltage circuit breaker.

In accordance with a preferred embodiment of the present invention, there is provided a new and improved single pole, solenoid operated, high voltage vacuum-type circuit interrupter. While disclosed as a single pole structure for single-phase applications, three circuit interrupters constructed in accordance with the principles of the present invention may be suitably interconnected and controlled simultaneously to provide synchronized operation for three-phase applications.

A single or one-piece, elongated, ceramic insulating housing provides both the external, solid insulation between the line terminal and the switch terminal and the external solid insulation between the line terminal and electrical ground. The single ceramic housing is mounted on a metallic base that houses a solenoid operated toggle mechanism for actuating an elongated, dielectric operating rod. The operating rod has a movable contact of a pair of switch contacts secured thereto and effectuates the opening and closing of the switch contacts and thus the opening and closing of a high voltage electrical circuit by the circuit interrupter.

The switch contacts are disposed in an elongated, generally tubular, evacuated ceramic casing. The ceramic casing includes a relatively shallow recess formed about its internal periphery intermediate the longitudinal ends thereof. A generally tubular, metallic, vapor shield, that provides a condensing surface for metallic vapor products resulting from electrical arcing across the open switch contacts, is securely disposed within the ceramic casing. More specifically, a plurality of metallic ring segments are positioned in the recess in the ceramic casing and radially outwardly protuberant portions are formed about the outer periphery of the tubular metallic shield both above and below the location of the ring segments thereby to secure the metallic shield to the ring segments disposed in the recess and, thus, the tubular shield to the ceramic casing.

The movable end of an expandable metallic bellows is fixedly secured to the conductive contact stem of the movable switch contact to preserve the vacuum within which the switch contacts operate while enabling separation of the switch contacts. The contact stem of the movable switch contact is directly electrically connected to an electrically conductive side or line terminal protruding radially outwardly from the side of the insulating housing through a hole formed through the wall thereof. The line terminal has a longitudinal axis transversely or perpendicularly disposed to the longitudinal axis of an electrically conductive top or switch terminal remotely disposed at the upper longitudinal end of the insulating housing. In the preferred embodiment, the switch terminal comprises a formed or flattened longitudinal end of an elongated, electrically conductive contact stem of the fixed switch contact. Similarly, the line terminal comprises a formed or flattened end of an elongated, electrically conductive, metallic tube.

The high voltage switch components of the circuit interrupter are encapsulated within the insulating housing by a closed-cell, solid, high dielectric foam. The insulating housing is mechanically secured to the base by the wedging action of a coil or garter spring disposed under tension on an exterior inclined surface of the insulating housing at the lower longitudinal end thereof and on an interior inclined surface of the base. A flexible solid pressure equalization diaphragm formed in situ in the base from a liquid vinyl plastisol is disposed at one end of the base and is movable to equalize the pressure within the base with that representative of ambient conditions outside of the base, thereby to prevent the ingress of moisture or other environmental contaminants which could cause damage to or the destruction of the internal components of the circuit interrupter. A visually discernible position indicator for the switch contacts is located within the base, is visible through a sight glass or lens secured to the bottom of the base and includes a movable position indicator arm secured to at least one movable part of the toggle mechanism for movement therewith to provide a visual indication to an observer of the "OPEN" or "CLOSED" position of the switch contacts.

The contacting portions of the switch contacts are formed by being brazed within elongated, tubular, electrically conductive contact stems. Specifically, each copper impregnated, tungsten contacting portion is disposed within an elongated, tubular, copper contact stem and is brazed substantially flush with an end of the contact stem. Subsequently, a portion of the contact stem at the that end is removed to reduce the possibility of the welding together of the copper portions of the switch contacts.

BRIEF DESCRIPTION OF THE DRAWING

These and other objects and advantages and novel features of the present invention will become apparent from the following detailed description of a preferred embodiment of the present invention illustrated in the accompanying drawing wherein:

FIG. 1 is a top elevational view of a high voltage vacuum-type circuit interrupter constructed in accordance with the principles of the present invention;

FIG. 2 is a side elevational view of the device of FIG. 1;

FIG. 3 is a cross sectional view of the device of FIGS. 1 and 2 taken along line 3—3 of FIG. 1 depicting the switch contacts of the device of FIG. 1 in their "OPEN" position;

FIG. 4 is a partial cross sectional view of a portion of the device of FIGS. 1 and 2 taken along line 4—4 of FIG. 3;

FIG. 5 is a partial bottom plan elevational view of a portion of the device of FIGS. 1 and 2 taken along line 5—5 of FIG. 3;

FIG. 6 is a cross sectional view similar to the view of FIG. 3 differing, however, in depicting the switch contacts of the device of FIGS. 1 and 2 in their "CLOSED" position;

FIG. 7 is a partial cross sectional view of a portion of the device of FIGS. 1 and 2 taken along line 7—7 of FIG. 6;

FIG. 8 is a partial bottom plan elevational view of a portion of the device of FIGS. 1 and 2 taken along line 8—8 of FIG. 6;

FIG. 14 is a bottom plan cross sectional view of a portion of the device of FIGS. 1 and 2 taken along line 14—14 of FIG. 3;

FIG. 15 is an enlarged, fragmentary cross sectional view of a portion of the device of FIGS. 1 and 2 taken along line 15—15 of FIG. 14;

FIG. 16 is an enlarged, fragmentary, cross sectional view of a portion of the device of FIGS. 1 and 2 taken along line 16—16 of FIG. 14;

FIG. 17 is an exploded perspective view of a portion of the device of FIGS. 1 and 2 depicting the assembly of that portion of the device;

FIG. 18 is a fragmentary, cross sectional view of a portion of the device of FIGS. 1 and 2 depicting the mounting of a fixed switch contact stem prior to its formation as the top or switch terminal;

DESCRIPTION OF THE PREFERRED EMBODIMENT

Figure 9:
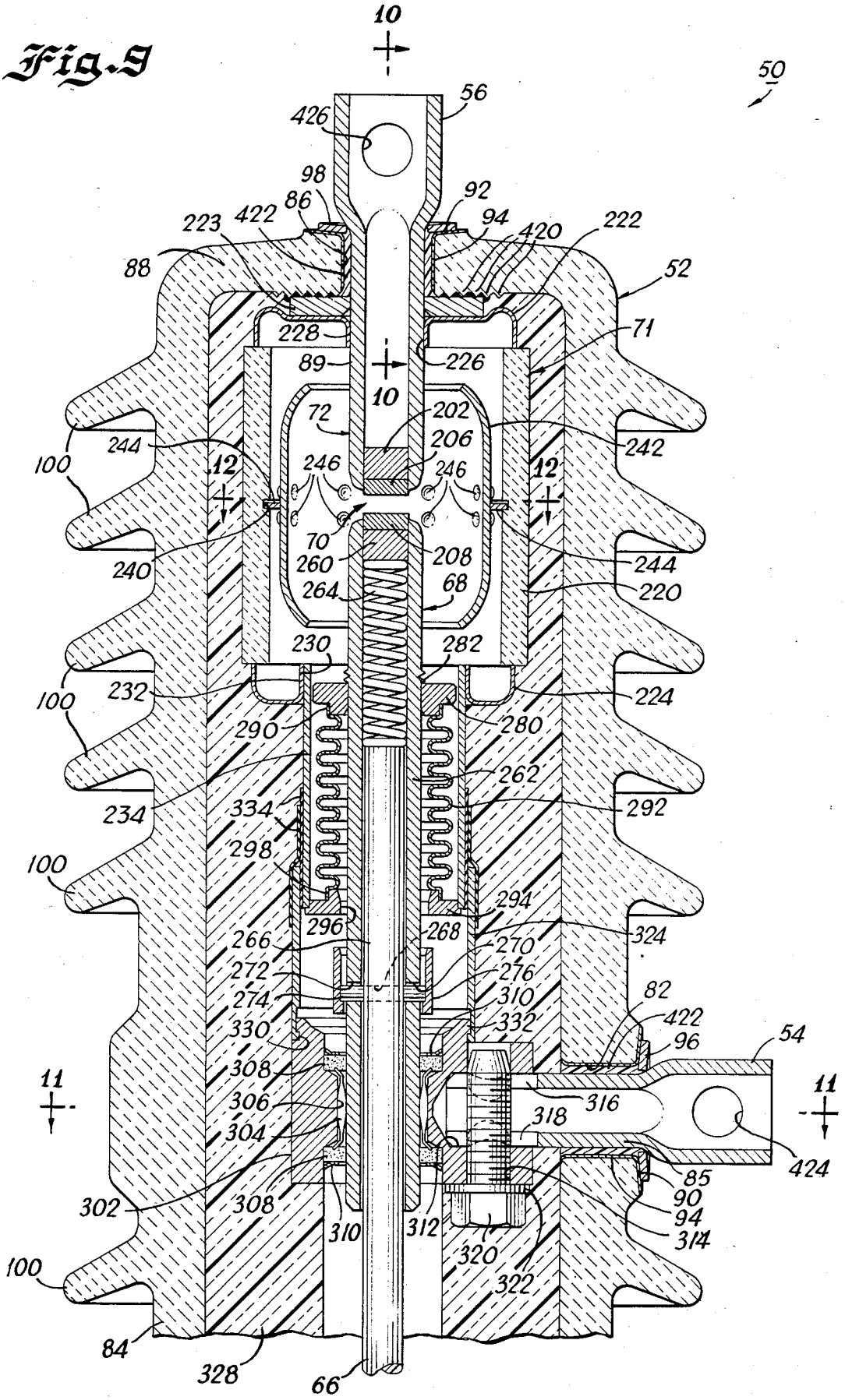
FIG. 9 is an enlarged, fragmentary, cross sectional view of a portion of the device depicted in FIG. 3.

Referring to the drawing and initially to FIGS. 1–5, there is illustrated a new and improved high voltage vacuum-type circuit interrupter 50. The circuit interrupter 50 includes a single or one-piece, elongated, ceramic insulating housing 52, preferably formed from porcelain, that provides both the solid external insulation between a side or line electrical terminal 54 and a top or switch electrical terminal 56 and the solid external insulation between the line terminal 54 and electrical ground. The insulating housing 52 is securing affixed to and supported by a two-part metallic base 58 that includes a metallic top casting 60 and a metallic housing 62 and that, in operation, is normally maintained at ground potential. The base 58 encloses a solenoid operated toggle mechanism 64 that actuates and controls an elongated, dielectric operating rod 66. Disposed at the uppermost longitudinal end of the rod 66 is a movable switch contact 68, one of a pair of switch contacts 70 that are disposed in a vacuum module 71. The movable switch contact 68 is movable relative to a stationary or fixed switch contact 72 to open (FIG. 3) or close (FIG. 6) a low resistance or short circuit electrical path between the terminals 54 and 56. A visually discernible position indicator 74 located within the housing 62 provides a visual indication of the "OPEN" or "CLOSED" position of the pair of switch contacts 70 and thus of the status or condition of the circuit interrupter 50. A solid, flexible pressure equalization diaphragm 76 is disposed about a major portion of the inner periphery of the metallic housing 62; and portions thereof are movable to equalize the pressure within the base 58 with that representative of ambient conditions outside thereof to prevent the ingress of moisture or other environmental contaminants which could result in damage to or the destruction of the internal components of the circuit interrupter 50.

Housing 52 and Base 58

The insulating housing 52 (FIGS. 1–3, 9–11, 17 and 18) is formed with a hole 82 through its sidewall 84. The hole 84 is sufficiently large diametrically to accommodate the passage therethrough of an elongated, electrically conductive metallic tube 85 (FIG. 17), the outermost end of which is subsequently mechanically pressed to form the terminal 54 (FIGS. 2 and 3). The insulating housing 52 also has a hole 86 (FIG. 17) formed through its top wall 88 with a diameter sufficiently large to accommodate the passage therethrough of an elongated, electrically conductive metallic tube or contact stem 89, the outermost end of which is also subsequently mechanically pressed to form the terminal 56 (FIGS. 2 and 3).

The insulating housing 52 also has concave surfaces 90 and 92 (FIG. 17) formed on its exterior surface adjacent to and about the holes 82 and 86, respectively. Preferably, a layer of conductive paint 94 is applied to the inner periphery of each of the holes 82 and 86 and to the concave surfaces 90 and 92. The concave surfaces 90 and 92 respectively seat bronze washers 96 and 98 that function as springs for properly positioning the switch components of the circuit interrupter 50 upon the formation of the terminals 54 and 56.

The insulating housing 52 also has a plurality of weathersheds 100 integrally formed along its exterior surface and an electrially conductive coating 102 applied to its exterior peripheral surface along a relatively short axial length thereof below the lowermost weathershed 100 (FIGS. 15 and 16) to reduce the possibility of a voltage discharge across the gap between the insulating housing 52 and the top casting 60 of the base 58.

In accordance with an important feature of the present invention, the insulating housing 52 is mechanically secured to the base 58 in the following manner. A plurality of four, integrally formed, upstanding posts or protrusions 110 are preferably equally spaced about the outer periphery of the top casting 60 at an upper, radially inwardly disposed, generally horizontal, annular surface 112. The surface 112 further includes an innermost lip portion 114 that is upwardly inclined preferably at an angle of from about 20° to about 25° with respect to horizontal, that is, with respect to a line or plane perpendicular to the longitudinal axis of the insulating housing 52.

Initially, a sufficient quantity of a commercially available liquid sealant is applied to the exterior of the top casting 60 along the surface 112 to form a sealing gasket 116. Subsequently, the insulating housing 52 is properly seated on the top casting 60 by inserting the lowermost end of the insulating housing 56 through a central aperture 118 in the top casting 60. The posts 110 properly locate and seat the insulating housing 52 on the top casting 60 and limit the side-to-side movement of the insulating housing 52.

An elongated coil or garter spring 120 is stretched and tensioned and is positioned in contact with and between the underside of the lip portion 114 of the surface 112 and the exterior of an outwardly inclined portion 122 of a lowermost integrally formed shoulder portion 124 of the insulating housing 52. The outwardly inclined portion 122 is downwardly inclined preferably at an angle of approximately 45° with respect to horizontal, that is, with respect to a line or plane perpendicular to the longitudinal axis of the insulating housing 52. The spring 120 is maintained under tension and in wedging contact with the inclined lip portion 114 and the inclined portion 122 by having its hooked ends 126 (FIG. 14) interconnected, thereby securely retaining the insulating housing 52 in supported contact with the top casting 60 of the base 58. The same wedging action imparted by the spring 120 also insures that the sealing gasket 116 forms an effective annular, hermetic seal between the top casting 60 and the insulating housing 52. Masses of epoxy 128 (FIGS. 14 and 16) are preferably applied to the spring 120 in a plurality of locations about its region of contact with the lip portion 114 and the inclined portion 122 to insure that the spring 120 is retained in position upon the hardening of the epoxy resin.

The top casting 60 also includes an annular recess 130 for locating and retaining an annular rubber gasket 132 used to provide a hermetic seal between the top casting 60 and the metallic housing 52 of the base 58. A plurality of four, generally vertically extending apertures 134 are formed through four enlarged portions 136 of the top casting 60 at locations about its outer periphery for receipt of a plurality of threaded bolts 140. When the plurality of locking nuts 142 are secured in tight threaded engagement with the bolts 140, an uppermost, annular, outwardly inclined lip portion 144 of the metallic housing 62 is maintained in compressive contact with the gasket 132 and annular wall portions of the top casting 60, securely retaining the metallic housing 62 in contact with the top casting 60 and effecting a hermetic seal therebetween.

A plurality of three, integrally formed protrusions 146 extend downwardly from the underside or inner surface of the top casting 60. Each of the protrusions 146 includes a threaded bolt 148 enclosed therein during the casting operation; and an elongated threaded portion of each of the bolts 148 extends downwardly from the lowermost portion of each of the protrusions 146. The downwardly projecting threaded portions of the bolts 148 extend through aligned apertures 150 formed in a generally triangularly shaped mounting plate 152 that mounts the toggle mechanism 64 in the base 58. A plurality of three washers 154 and three nuts 156 fixedly secure the mounting plate 152 to the bolts 148 and thus to the top casting 60. A plurality of at least two apertures 158 are formed in the mounting plate 152 in alignment with a plurality of at least two threaded apertures 160 formed in a mounting block 162 of the toggle mechanism 64 for the threaded receipt of a plurality of at least two threaded bolts 164 that maintain the mounting block 162 and thus the toggle mechanism 64 fixedly secured to the mounting plate 152 and properly registered within the base 58.

The top casting 60 also has an integrally formed cable passageway 170 for hermetically sealed low voltage electrical leads (not illustrated) that provide control signals for the toggle mechanism 64. The metallic housing 62 includes a generally centrally disposed aperture 172 that functions as a sight port through which the functional condition of the pair of switch contacts 70 may be determined. The metallic housing 62 also has at least one vent hole 174 formed therethrough under flexible portions of the pressure equalization diaphragm 176 permitting either the ingress of air into or the egress of air from the metallic housing 62 on the side of the diaphragm 76 that is exposed to the external environment to equalize the pressure within the base 58 with that representative of ambient conditions outside of the base 58. A sight glass or lens 176 is positioned over the aperture 172 and is securely affixed and sealed to the metallic housing 62 by any suitable means, such as a sealing adhesive 178. An apertured bracket 180 for mounting the circuit interrupter 50 to any suitable supporting structure is fixedly secured to the exterior of the metallic housing 62 by any suitable means, such as by welding.

Diaphragm 76

Figures 19, 20, 21, 22, 23:
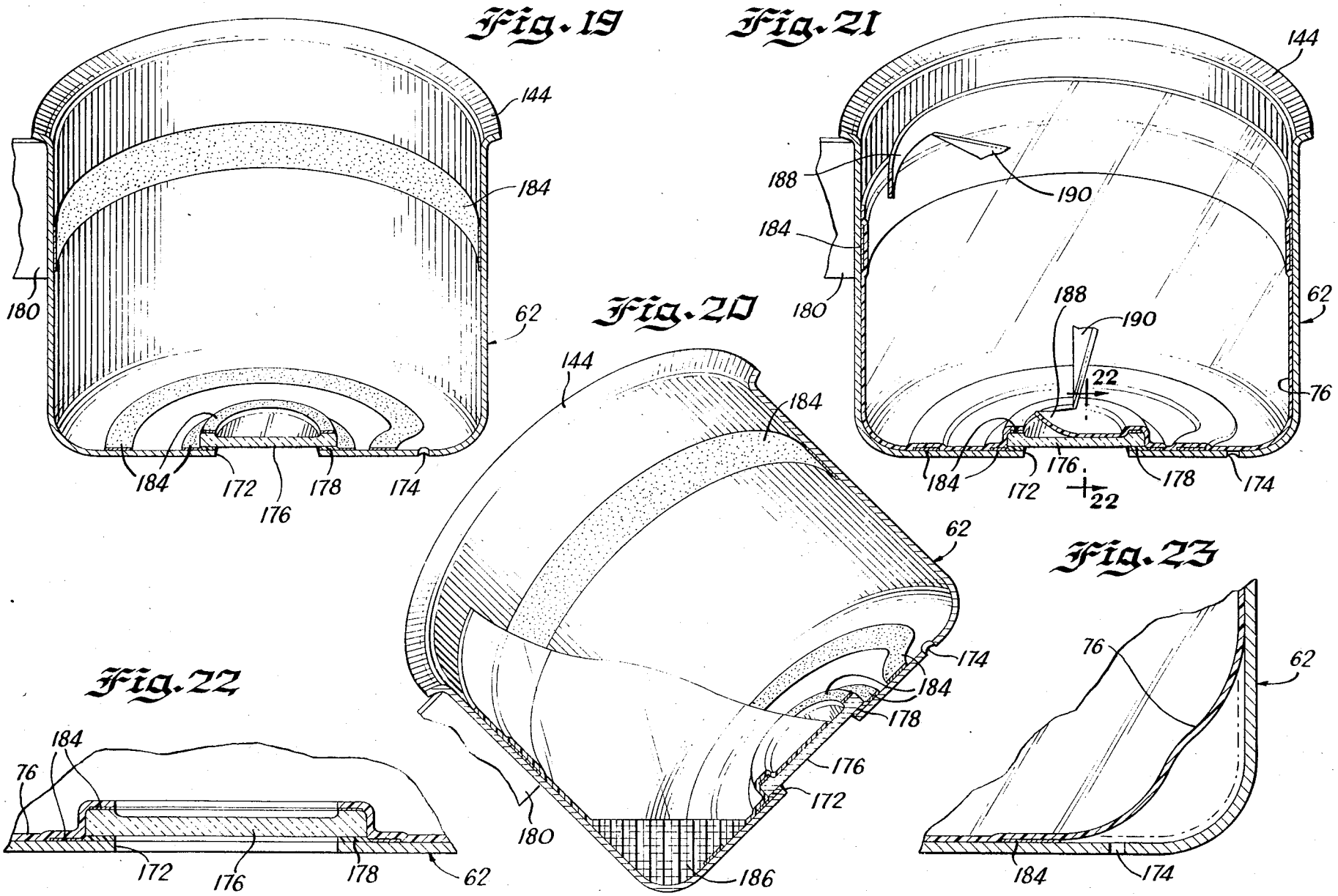
FIGS. 19–23 are fragmentary views of a portion of the device of FIGS. 1 and 2 depicting the formation or method of manufacture of a flexible pressure equalization diaphragm in situ in the metallic base of the device.
Figure 24:
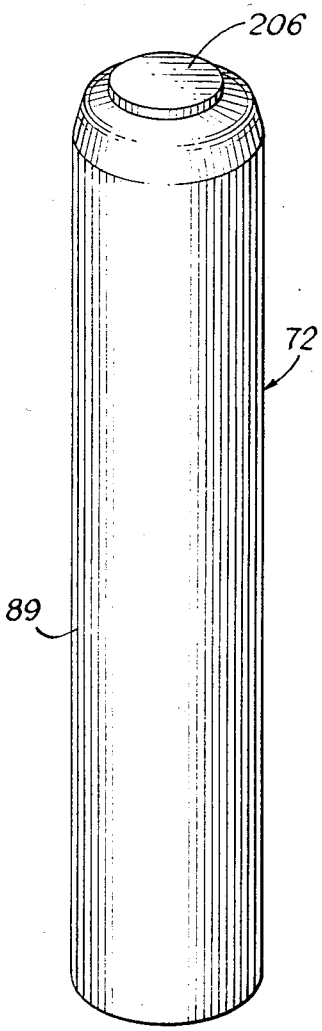
FIGS. 24–28 are enlarged, fragmentary views of a portion of the device of FIGS. 1 and 2 depicting a switch contact and a switch contact stem and the formation or method of manufacture of a switch contact for the device.
Figure 25:
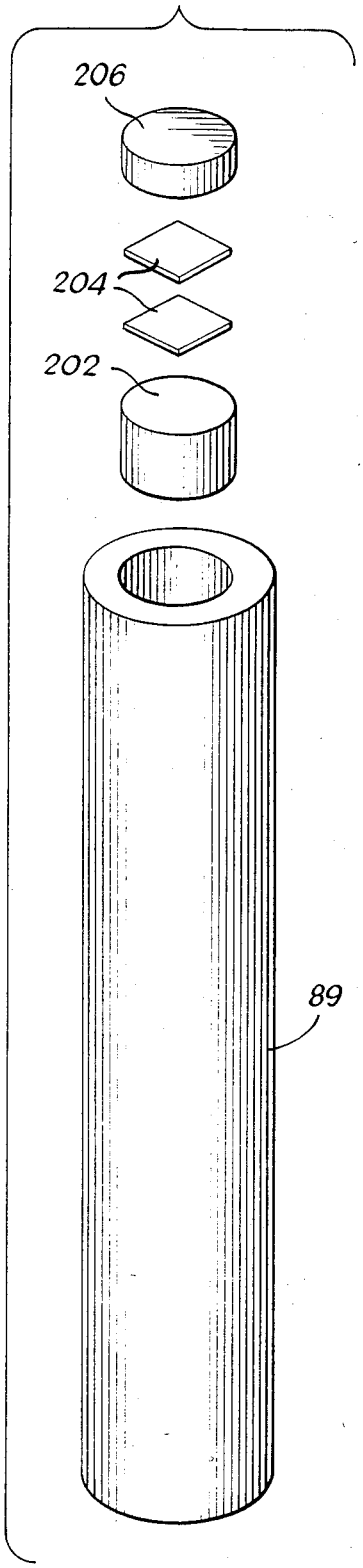
Figure 26:
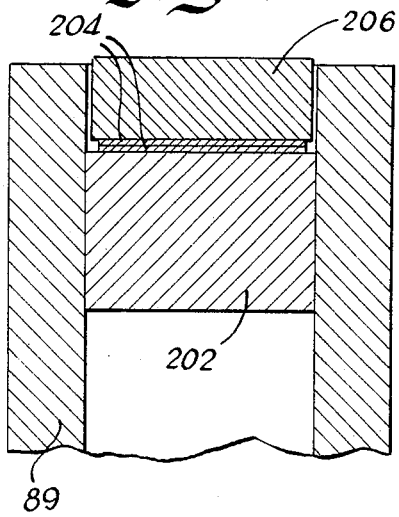
Figure 27:
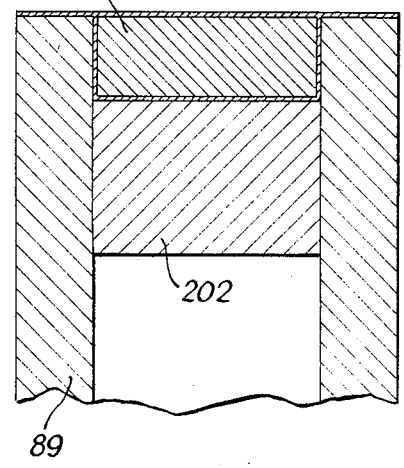
Figure 28:
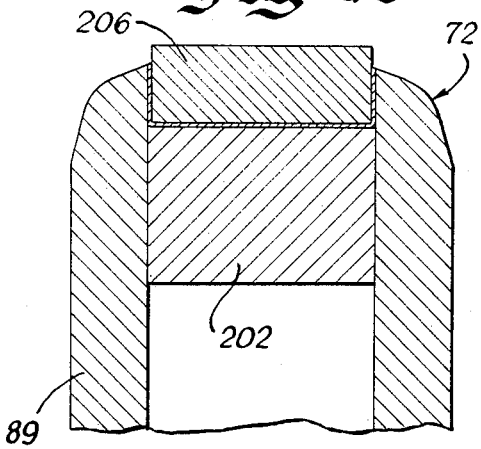

In accordance with an important feature of the present invention, the flexible pressure equalization diaphragm 76 is formed in situ within the base 58 (FIGS. 3 and 19–22) in the following manner. Initially, a primer 184 in the form of a commercially available high temperature adhesive is applied to those interior portions of the metallic housing 62 to which it is desired that the pressure equalization diaphragm 76 adhere. Specifically, as illustrated in FIG. 19, a continuous annular ring of the primer 184 is applied about the upper, inner periphery of the sidewall of the metallic housing 62 along a short axial length thereof. The primer 184 is also applied as an annular ring along the inner surface of a bottom wall of the housing 62. Care should be taken to ensure that this annular ring is positioned radially inwardly of the vent hole 174, thereby to permit the exposure of a major portion of the flexible diaphragm 76 to external ambient conditions and consequent movement, if necessary, by that major portion of the diaphragm 76 to equalize the pressure outside of the base 58 with that within the base 58 (FIG. 23). A further annular ring or coating of the primer 184 is applied to the interior surface of the bottom wall of the metallic housing 62 immediately adjacent to and in contact with the adhesive 178 and/or the lowermost portion of the sight glass 176. Preferably, an annular coating or ring of the primer 184 is also applied to the upper surface of the sight glass 176, thereby insuring an effective hermetic seal between the sight glass 176 and the metallic housing 62.

After the various coatings of the primer 184 have been permitted to air dry, the metallic housing 62 is raised to an elevated temperature, for example, 375° F., and maintained at that temperature for a period of time, for example, fifteen minutes. Subsequently, while the metallic housing 62 is still substantially at the same elevated temperature, a commercially available liquid vinyl plastisol 186, used to form the diaphragm 76, is poured into the metallic housing 62 (FIG. 20). The metallic housing 62 is then rotated to evenly coat the desired interior surfaces, namely its sidewalls and its bottom wall and the sight glass 176, with a layer of the plastisol 186. Care should be taken that the coating of the plastisol 186 is smooth and covers those portions of the metallic housing 62 and of the sight glass 176 that have been primed and all portions therebetween. The excess liquid vinyl resin composition 186 is poured out of the metallic housing 62; and the metallic housing 62 is then immediately raised to an elevated temperature, for example, 375° F., for a period of time, e.g., fifteen minutes, to cure or solidify the plastisol 186. Subsequently, the metallic housing 62 is permitted to cool. Excess portions 188 (FIG. 21) may be removed using a sharpened knife edge 190 thereby to provide the solid, flexible, pressure equalization diaphragm 76 that is capable of movement within the base 58 in response to pressure changes.

Switch Contacts 70

In accordance with a further important feature of the present invention, the movable switch contact 68 and the stationary switch contact 72 of the pair of switch contacts 70 are manufactured in accordance with the following method. While the manufacturing method of FIGS. 24–28 specifically depicts the stationary switch contact 72, the same method is used for manufacturing the movable switch contact 68.

The switch contact 72, as initially assembled (FIG. 26), includes an elongated, tubular, electrically conductive contact stem 89, preferably formed from copper; a contact support block or slug 202, preferably also formed from copper; one or more preforms 204, formed from a suitable brazing alloy; and a contacting portion 206 formed from copper impregnated tungsten. Specifically, the support block 202 which has outer dimensions configured to form an interference fit with the inner dimensions of the contact stem 89 is inserted into the contact stem 202 to a depth substantially equal to the thickness or axial length of the contacting portion 206. Subsequently, the preforms 204 are inserted into the contact stem 89 to rest on the support block 202. The contacting portion 206 is then inserted into the contact stem 89 and is brazed flush with the end of the contact stem 89 (FIG. 27) by elevating the temperature of the assembly sufficiently to liquify the preforms 204. Subsequently, portions of the contact stem 89 adjacent the contacting portion 206 are machined away (FIG. 28); and any remaining brazing alloy from the preforms 204 that is exposed is removed so that a nonwelding tungsten contacting portion 206 protrudes above the contact stem 89 for engagement with the corresponding contacting portion 208 (FIG. 9) of the movable switch contact 68.

Vacuum Module 71 and Shield 242

The vacuum module 71 (FIGS. 3, 9, 12, 13 and 17) provides a housing and an evacuated environment for the operation of the pair of switch contacts 70. The module 71 includes an elongated, generally tubular, evacuated, ceramic casing 220, preferably formed from alumina; an upper metallic flange 222 fixedly secured to and hermetically sealed to the upper longitudinal end of the casing 220; an annular conductive washer 223, preferably formed from copper and preferably fixedly secured, for example, by welding or brazing, to an upper, centrally disposed planar surface of the flange 222; and an annular lower metallic flange 224 fixedly secured to and hermetically sealed to the lower longitudinal end of the casing 220. The flange 222 includes a central aperture 226 formed by axially extending sidewalls 228 that are securely affixed, such as by welding or brazing, to the stem 89 of the stationary contact 72. Similarly, the lower flange 224 has a central aperture 230 formed by axially extending sidewalls 232 that are fixedly secured, such as by welding or brazing, to an elongated guide tube 234, preferably formed from stainless steel.

In accordance with an important feature of the present invention, the casing 220 includes a relatively shallow recess 240 (FIGS. 9 and 13) formed about its inner periphery intermediate the longitudinal ends thereof. A generally tubular metallic vapor shield 242 (FIGS. 9, 12 and 13), preferably formed from copper, is securely disposed within the casing 220 and provides a condensing surface for metallic vapor products resulting from electrical arcing across the open switch contacts 70. More specifically, a plurality of four metallic ring segments 244 are positioned in the recess 240. Preferably, the four ring segments are formed by two, spaced apart parallel cuts completely through an annular metallic ring, the cuts being transverse to the plane of the upper planar surface of the metallic ring.

Subsequently, the shield 242, initially having an outer configuration that is generally smooth or of a constant profile, is positioned in the casing 220 within the ring segments 244 such that the ring segments 244 are disposed generally midway between the longitudinal ends of the shield 242. Subsequently, means for mechanically capturing the ring segments 244, namely the outwardly protuberant portions 246, are formed about the outer periphery of the shield 242 both above and below the location of the ring segments 244 thereby capturing the ring segments 244 in the recess 240 between the upper and lower formations of the protuberant portions 246 and, thus, securing the shield 242 to the ceramic casing 220. The upper and lower, axially spaced protuberant portions 246 form an axially extending capture region 248 therebetween having an axial length substantially equal to the thickness of the ring segments 244 to reduce to a minimum the relative axial movement between the ring segments 244 and the shield 242. Thus, an improved, rapid and inexpensive method is provided for supporting a high thermal expansion component, such as the vapor shield 242 within a low thermal expansion housing, such as the casing 220.

In an alternative embodiment, a plurality of protuberant portions 246, all generally located or formed at the same horizontal plane above the location of the ring segments 244, may be formed in the shield 242 either prior to or subsequent to its positioning within the casing 220. The shield 242 will thus rest under the influence of gravity on the ring segments 244. Short lengths of brazing alloy in wire form may then be placed at one or more locations on the upper surfaces (FIG. 9) of the ring segments 244. Subsequently, the assembly is raised to its brazing temperature. The metallic shield 242 at the elevated brazing temperature will expand to form a tight fit with the inner peripheries of the ring segments 244 that are fixed in the recess 240. In accordance with a preferred embodiment of the present invention, the ring segments 244 are formed from a metal, such as iron, having a significantly lower coefficient of thermal expansion than that of the shield 242, but greater than that of the ceramic casing 220. Upon cooling, the metallic shield 242 will be connected by the congealed brazing alloy to the ring segments 244 which will have shrunk radially inwardly from the bottom or radially outermost portion of the recess 240 by a small but tolerable distance. Alternatively, rather than forming a plurality of spaced apart protuberant portions 246, a single continuous protuberant portion 246 may be formed in the shield 242 as a circumferentially extending, radially outwardly projecting ridge for seating the shield 242 on the ring segments 244 prior to the brazing operation.

Internal Switch Components

The movable switch contact 68 (FIG. 9) includes the copper-impregnated, tungsten contacting portion 208, a contact support block 260 and an elongated electrically conductive contact stem 262. Disposed within the contact stem 262 is an elongated preload spring 264 and an elongated end portion 266 of the dielectric operating rod 66. To connect the contact stem 262 to the end portion 266, a hole 268 is formed through the end portion 266; and two, oppositely disposed, coaxial holes 270 and 272 are formed through the wall of the contact stem 262, the centers of the holes 270 and 272 being along a common axis that passes through and is perpendicular to the central longitudinal axis of the contact stem 262. The end portion 266 of the operating rod 66 is inserted into the open end of the contact stem 262 compressing the preload spring 264; and the end portion 266 is rotated relative to the contact stem 262 until the holes 268, 270 and 272 are aligned. Then, an elongated rigid retaining pin 274 is inserted through the aligned holes 268, 270 and 272 to securely retain the contact stem 262 interconnected with the end portion 266. The pin 274 is held in position by a pin retaining collar or split ring 276 disposed about the outer periphery of the contact stem 262.

An annular metallic slider 280, preferably formed from copper, is fixedly secured, for example, by welding, to the outer surface of the contact stem 262 immediately below and in engagement with a radially outwardly protuberant portion or ridge 282 formed along the outer surface of the contact stem 262. The largest outer diameter of the slider 280 is slightly less than the inner diameter of the guide tube 234 to enable relative movement between the movable switch contact 68 and the guide tube 234 while maintaining the movable switch contact 68 in axial alignment with the stationary switch contact 72. A movable upper end 290 of a metallic bellows 292 is fixedly secured and sealed, for example, by welding or brazing, to a lower, reduced diameter portion of the slider 280 for movement with the movable switch contact 68 to preserve the vacuum within which the pair of switch contacts 70 operate. An annular metallic cap 294, preferably formed of stainless steel, is fixedly secured, for example, by welding, to the lower end of the guide tube 234. The cap 294 has a centrally disposed aperture 296 with an inner diameter greater than the outer diameter of the contact stem 262 to enable the movable switch contact 68 to pass unimpeded therethrough. The stationary lower end 298 of the metallic bellows 292 is fixedly secured and sealed to an upper reduced diameter portion of the metallic cap 294; and the metallic cap 294 is fixedly secured and sealed to the lower end of the guide tube 234 by any suitable means, such as by welding or brazing.

Means are provided for maintaining a direct electrical connection through a low resistance or short circuit electrical path between the contact stem 262 of the movable switch contact 68 and the side terminal 54. Such contacting means includes a metallic contact block 302 (FIGS. 3, 9, 11 and 17), preferably formed from copper. Centrally disposed within the contact block 302 is a radially resilient metallic contact member 304, preferably formed from copper, that is used to maintain an effective continuous electrically conductive contact between the contact block 302 and the movable contact stem 262. The contact member 304 is maintained in position in contact with a reduced inner diameter portion 306 of the contact block 302 by a pair of upper and lower felt sealing washers 308 that, in turn, are securely retained in position against the reduced inner diameter portion 306 by upper and lower retaining washers 310 that are pressed into position within the contact block 302 in contact with the adjacent lateral surfaces of the sealing washers 308 and in locking engagement with the inner wall portions of the contact block 302.

The contact block 302 further includes a radially extending elongated aperture 312 and an axially extending elongated aperture 314 having a longitudinal axis perpendicularly disposed to the longitudinal axis of the aperture 312. The aperture 312 is designed to receive the slotted end of the metallic tube 85. The tube 85 includes a pair of oppositely disposed, axially aligned, holes 316 and 318 that are axially aligned with the axially extending aperture 314 to enable an elongated, threaded, self-forming electrically conductive screw 320 to be received in and to threadedly engage conductive metal portions forming the aperture 314 and the holes 316 and 318 to retain the metallic tube 85 securely in engagement with and in proper alignment in the contact block 302. A metallic lock washer 322 may be interposed between screw 320 and the contact block 302.

A tubular metallic sheet or cover 324 is telescopically disposed over an elongated end portion of the guide tube 234 and over an elongated end portion of the contact block 302. The primary purpose of the cover 324 is to serve as a barrier to prevent the ingress of a closed-cell, solid, high dielectric foam insulation 328, preferably formed from polyurethane, into the region defined by the interior of the cover 324. The cover 324 is securely engaged by the contact block 302 in any suitable manner, for example, by a rib 330 that is formed at the lower end of the cover 324 and that is retained under a peripherally disposed shoulder 332 formed at the upper longitudinal end of the contact block 302 by a snap fit between the rib 330 and the shoulder 332. Preferably, one or more layers or sheets 334 formed, for example, from polyethylene terephthalate are disposed over the telescoped lower portion of the guide tube 234 and upper portion of the cover 324 to form a seal therebetween to prevent the ingress of the high-dielectric foam insulation 328 into the region defined by the interior of the cover 324.

Toggle Mechanism 64 and Position Indicator 74

The toggle mechanism 64 (FIGS. 3, 4, 6 and 7) includes the mounting block 162, a first generally cylindrically shaped, annular electrical coil 340, a second generally cylindrically shaped, annular electrical coil 342 and a movable magnetic core or armature 344. When the coil 340 is energized, the armature 344 assumes the position illustrated in FIGS. 3 and 4. When the coil 342 is energized, the armature 344 assumes the position illustrated in FIGS. 6 and 7. The stationary coils 340 and 342 are secured by a plurality of three mounting plates 346, by a plurality of four spacers 348 and by a plurality of at least two mounting bolts 350 to the mounting block 162 for support thereby. A sleeve 352 within which the magnetic core 344 moves is centrally disposed within the coils 340 and 342. One threaded longitudinal end of a rigid drive arm 354 threadedly engages and is thereby secured to one longitudinal end of the armature 344 for movement therewith. An elongated aperture 356 (FIG. 7) is formed in the opposite longitudinal end of the drive arm 354 along an axis transverse to the longitudinal axis of the drive arm 354. A rigid pin 358 passes through the aperture 356 and is thus movable by the drive arm 354. A pair of rigid spacers 360 are mounted on the pin 358 for movement therewith and are disposed between the drive arm 354 and a first pair of lower, movable toggle links 362. The pin 358 extends through aligned apertures formed at first, upper longitudinal ends of the toggle links 362 to enable the toggle links 362 to be moved by the pin 358. The pin 358 also passes through aligned holes formed in the lower longitudinal ends of a pair of upper, toggle links 364 such that those ends of the toggle links 364 are movable in response to the movement of the pin 358. The same ends of the toggle links 364 are spaced by spacers 366 and 368 and a movable position indicator arm 370 from the upper longitudinal ends of the toggle links 362 along the pin 358. The pin 358 passes through a hole formed through the lateral surface of the position indicator arm 370. The above components are securely retained in position on the pin 358 by any suitable means, such as the pair of washers 372 and a pair of C-clamps 374. The pin 354 and the components secured thereto are thus capable of controlled lateral movement within a generally U-shaped, laterally extending slot 376 in the mounting block 162 in response to movements of the armature 344.

Horizontally aligned apertures are formed through the lower ends of the toggle links 362 for receipt therethrough of a rigid pin 380. Similarly, horizontally aligned apertures are formed through the upper ends of the upper toggle links 364 for receipt therethrough of a rigid pin 382. The pin 380 also passes through separated, horizontally aligned apertures 384 formed through the mounting block 162. The aligned apertures 384 are formed as slots to allow translation of the rigid pin 380 along the longitudinal axis of the circuit interrupter 50. The rigid pin 382 passes through a pair of separated, horizontally aligned, axially elongated apertures 386 in a mounting block 162. The inner axially extending dimensions of the apertures 386 are substantially greater than the outer diameter of the rigid pin 382 to enable substantial axial movement of the rigid pin 382 along the longitudinal axis of the circuit interrupter 50, that is, axial movement equal to the gap spacing between the pair of switch contacts 70 in their "OPEN" position (FIG. 3).

Disposed along the rigid pin 380 are a plurality of two spacers 388 and a plurality of four washers 390. Similarly, disposed along the rigid pin 382 are a pair of bushings 392, a pair of washers 394 and a pair of spacers 396. The pins 380 and 382 are maintained in position and biased towards each other by a pair of elongated springs 398, the curved ends 402 of which are disposed about and secured in recesses at the longitudinal ends of the rigid pins 380 and 382 to maintain the springs 398 in tension. In this manner, the rigid pins 380 and 382, when the armature 344 is in the position depicted in FIG. 3, are biased by the springs 398 against relative axial movement in a first overcenter position of the toggle mechanism 64 in which the switch contacts 68 and 72 are held in their "OPEN" position. Upon movement of the armature 344 to the position depicted in FIG. 6, that is, upon energization of the electrical coil 342, the drive arm 354 moves the rigid pin 358 and thus the lower toggle links 362 and upper toggle links 364 and the rigid pins 380 and 382 to a second overcenter position of the toggle mechanism 64 in which the springs 398 hold the rigid pins 380 and 382 biased against relative axial movement such that the switch contacts 68 and 72 are maintained in contact in their "CLOSED" position.

The rigid pin 382 passes through horizontally aligned apertures 404 in a tubular rigid connecting sleeve 406. The lower longitudinal end of the elongated operating rod 66 is securely connected to the sleeve 406 by a pair of axially spaced, transversely disposed retaining pins 408 that pass through aligned apertures formed through the operating rod 66 and through the walls of the tubular sleeve 406. The sleeve 406 is retained in a circular bore 410 formed in the mounting block 162 having an inner diameter slightly larger than the outer diameter of the sleeve 406 to retain the retaining pins 408 in engagement with the sleeve 406 and the operating rod 66, to enable axial movement of the sleeve 406 along the longitudinal axis of the operating rod 66 and to prevent any substantial non-axial movement of the sleeve 406. Preferably, the apertures 404 in the sleeve 406 have an inner diameter substantially equal to the outer diameter of the rigid pin 382 to prevent relative axial movement therebetween. In this manner, the lateral movement of the armature 354 and of the drive arm 356 rigidly secured thereto, in response to the energization of either the electrical coil 340 or the electrical coil 342, is converted to axial movement of the rigid pin 382, the sleeve 406 and the elongated operating arm 66 to effect the opening and the closing of the pair of switch contacts 70. A compression spring 411 disposed in the lowermost portion of the bore 410 axially biases the pin 380 and thus the pin 382, the sleeve 406 and the operating rod 66.

The position indicator 74 (FIGS. 3–8) enables an observer to determine the functional condition of the pair of switch contacts 70 and thus of the circuit interrupter 50 by viewing visual discernible indicia through the sight glass 176. The position indicator 74 includes a visually discernible, human readable indication 412 of the "OPEN" condition of the pair of switch contacts 70 and thus of the circuit interrupter 50. The indication 412 is affixed or applied to a bottom lateral surface of the mounting block 162 in axial alignment with both the centrally disposed aperture 172 in the metallic housing 62 and the sight glass 176 so that the indication 412 may be observed therethrough. Preferably, the indication 412 takes the form of an applique or lettering bearing the word "OPEN" formed in a highly visually discernible manner, such as white lettering on a green background. Similarly, a visually discernible human readable indication 414 of the "CLOSED" condition of the pair of switch contacts 70 and thus of the circuit interrupter 50 is securely affixed or applied to a bottom laterally extending surface 416 of the movable position indicator arm 370. Preferably, the indication 414 is in the form of an applique or lettering bearing the word "CLOSED" in a highly visually discernible form, such as white lettering on a red background. When the pair of switch contacts 70 are in their "OPEN" position (FIGS. 3–5), the movable position indicator arm 370 secured at its upper end to the two rigid pins 358 and 382 is angled to the side and out of the way of the indication 412 which thus is visually discernible and easily readable by a human as indicative of the "OPEN" condition of the pair of switch contacts 70. When the pair of switch contacts 70 are in their "CLOSED" condition (FIGS. 6–8), the movable position indicator arm 370 is moved by the rigid pins 358 and 382 to a position in which the indication 414 overlies and obscures the indication 412. In this position, the indication 414 is axially aligned with the sight glass 176 and is easily visually discernible and readable by a human as indicative of the "CLOSED" condition of the pair of switch contacts 70.

General Assembly

Figure 10:
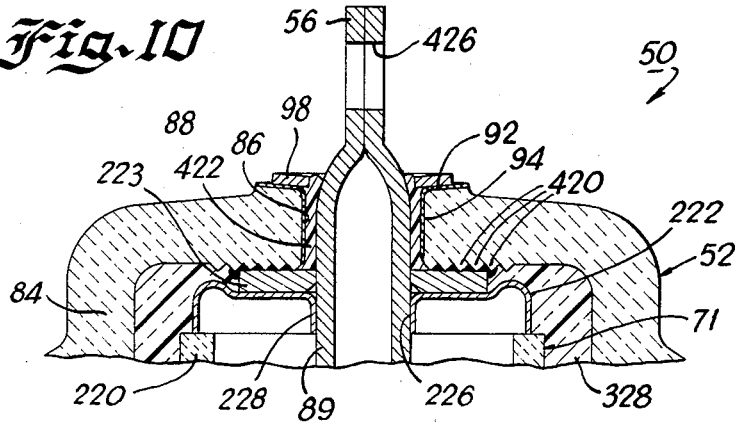
FIG. 10 is a fragmentary, cross sectional view of a portion of the device of FIGS. 1 and 2 taken along line 10—10 of FIG. 9.
Figure 11:
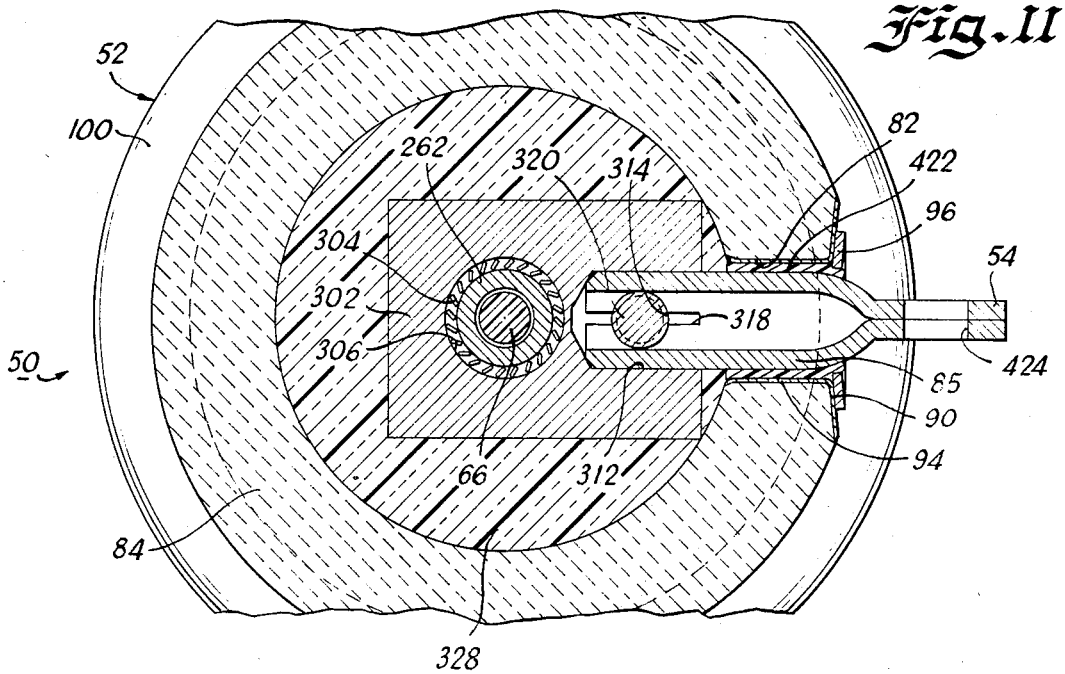
FIG. 11 is a plan cross sectional view of a portion of the device of FIGS. 1 and 2 taken along line 11—11 of FIG. 9.
Figure 12:
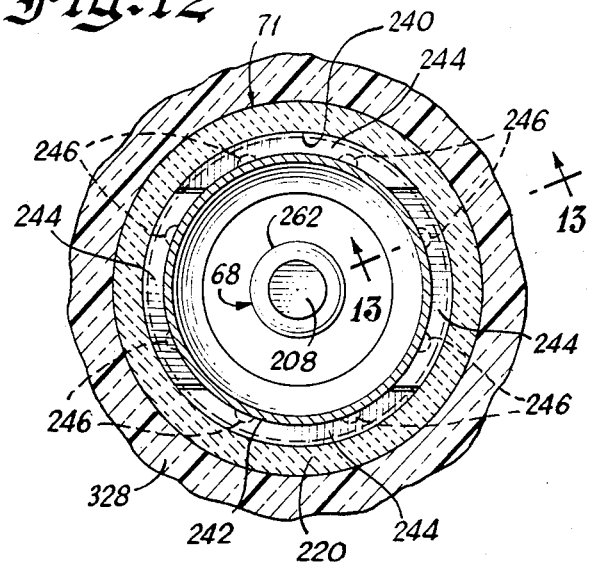
FIG. 12 is a fragmentary, plan cross sectional view of a portion of the device of FIGS. 1 and 2 taken along line 12—12 of FIG. 9.
Figure 13:
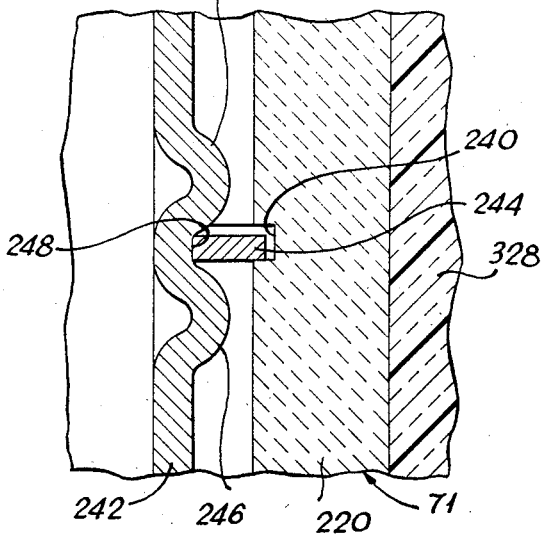
FIG. 13 is an enlarged, fragmentary, cross sectional view of a portion of the device of FIGS. 1 and 2 taken along line 13—13 of FIG. 12.

Initially, the stationary switch contact 72, the vacuum module 71, the movable switch contact 68, the guide tube 234, the cover 324, the contact block 302, the elongated operating rod 66 with the connecting sleeve 406 attached as described above to its lower end thereof and all of the other switch components described above that are internally disposed within these components are inserted as a unitary assembly into the interior of the insulating housing 52 (FIG. 17). Prior to insertion, an annular epoxy saturated foam washer 418 is disposed about the contact stem 89 and rests on the upper, laterally extending planar surface of the washer 223. When the above assembly is fully inserted into the insulating housing 52, the epoxy saturated foam washer 418 is pressed against a sand glazed annular surface 420 formed on the interior top wall 88 of the insulating housing 52 (FIG. 18). Subsequently, the metallic tube 85 is fully inserted into the aperture 312 of the contact block 302 through the hole 82 in the insulating housing 52; and the metallic tube 85 is rotated about its longitudinal axis until the holes 316 and 318 are axially aligned with the elongated aperture 314 in the contact block 302. When such alignment is achieved, the self-forming screw 320 and the lock washer 322 are threaded through the aperture 314 to securely retain the metallic tube 85 within the contact block 302. Subsequently, a silicone sealant 422 is inserted into the holes 82 and 86 of the insulating housing 52 about the metallic tube 85 and the contact stem 89. The washers 96 and 98 are then disposed about the metallic tube 85 and the contact stem 89, respectively; and the outwardly extending longitudinal ends of the metallic tube 85 and of the contact stem 89 are then formed or flattened in a hydraulic press to form the electrical terminals 54 and 56 and to deflect the bronze washers 96 and 98 which then function as springs to properly position the internal switch components of the circuit interrupter 50 (FIGS. 10–11). After the formation of the flattened terminals 54 and 56, the contact block 302 is fixedly held in position against portions of the sidewall 84 of the insulating housing 52; and the washer 223, having substantially fully compressed the epoxy saturated foam washer 418, is compressed against the sand glazed annular surface 420 of the top wall 88 of the insulating housing 52, such that the sand grains from the surface 420 are imbedded into the washer 223 through the fully compressed foam washer 418 to prevent movement of the vacuum module 71 when a load is applied to the electrical terminal 56. If desired, apertures 424 and 426 (FIG. 9) may then be formed through the electrical terminals 54 and 56, respectively, to facilitate the connection of electrical leads (not illustrated) thereto.

Preferably, an elongated tubular shield or cover (not illustrated) having an outer diameter equal to the inner diameter of the foam insulation 328 is inserted into the mounting block 302 and disposed about the downwardly depending exposed portion of the elongated operating rod 66 to provide the elongated central bore in the insulation 328 as depicted in FIG. 3, enabling unimpeded axial movement of the operating rod 66. Subsequently, the foam insulation 328 is injected under pressure into the interior of the insulating housing 52. When the foam insulation 328 has sufficiently settled and hardened, the tubular sleeve, disposed at that time about the elongated operating rod 66, may be removed.

The insulating housing 52 may then be fixedly secured to the top casting 60 of the base 58 as described hereinabove with reference to FIGS. 14–16. Subsequently, the lowermost end of the elongated operating rod 66 and the connecting sleeve 406 are received within the bore 410 of the mounting block 162 and are securely interconnected with the toggle mechanism 64 by the receipt of the rigid pin 382 through the aligned apertures 404 of the connecting sleeve 406. The toggle mechanism 64, secured to the mounting plate 152, may then be fixedly secured to the top casting 60 by means of the threaded bolts 148, the washers 154 and the nuts 156, as described hereinabove. Low voltage electrical leads (not illustrated) for the electrical coils 340 and 342 may then be directed through the capable passageway 170 in the top casting 60.

The assembled insulating housing 52 and the top casting 60 are then placed in contact with the lip portion 144 of the metallic housing 62 in which the flexible pressure equalization diaphragm 76 has already been formed in situ as described hereinabove. Subsequently, the metallic housing 62 is securely interconnected with and hermetically sealed to the top casting 60 to form the base 58 and a fully assembled circuit interrupter 50 by tightening the nuts 142 on the bolts 140 as described hereinabove. The circuit interrupter 50 is then ready for mounting in any convenient location utilizing the apertured mounting bracket 180.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. A high voltage circuit interrupter comprising a first electrical terminal adapted to be connected to a first high voltage power lead, a second electrical terminal adapted to be connected to a second high voltage power lead, an elongated, one-piece, rigid dielectric housing, said housing having a first opening disposed at one longitudinal end of said housing at which said first terminal is located and having a second opening, remotely disposed from both said first longitudinal end and a second longitudinal end of said housing, at which said second terminal is located, said housing providing both the solid external electrical insulation between said first and second terminals and the solid external electrical insulation between said second terminal and said second longitudinal end of said housing, and current interrupting vacuum switch means disposed within said circuit interrupter for selectively opening and, alternately, closing a short circuit electrical path between said first and second terminals, said switch means comprising a stationary switch contact and a movable switch contact, said movable switch contact being movable alternately into and out of engagement with said stationary switch contact to respectively close and open said short circuit electrical path, said switch means further comprising means for maintaining a vacuum within which said stationary and movable switch contacts operate, said vacuum maintaining means comprising an elongated, tubular, rigid, dielectric casing, said casing being disposed within said housing along the longitudinal axis thereof between said first opening and said second opening.

2. A high voltage circuit interrupter as recited in claim 1 wherein said first terminal comprises a flattened longitudinal end of a first elongated tubular metallic member.

3. A high voltage circuit interrupter as recited in claim 2 further comprising a first annular washer disposed between said first terminal and said housing and biased by said flattened longitudinal end of said first metallic member to form a first spring member adjacent said first opening of said housing.

4. A high voltage circuit interrupter as recited in claim 2 wherein said second terminal comprises a flattened longitudinal end of a second elongated tubular metallic member.

5. A high voltage circuit interrupter as recited in claim 4 further comprising a second annular washer disposed between said second terminal and said housing and biased by said flattened longitudinal end of said second metallic member to form a second spring member adjacent said second opening of said housing.

6. A high voltage circuit interrupter as recited in claim 4 wherein said first elongated tubular metallic member comprises a first elongated tubular contact stem of said stationary switch contact, a first contacting portion of said stationary switch contact, for physically contacting a second contacting portion of said movable switch contact, being mounted within said first elongated tubular metallic member at a second longitudinal end thereof, said first contacting portion axially projecting outwardly therefrom and having an outer diameter no greater than the inner diameter of said first elongated tubular metallic member.

7. A high voltage circuit interrupter as recited in claim 6 wherein said movable switch contact further comprises a second elongated tubular contact stem, said second contacting portion being mounted within and axially projecting outwardly from a first longitudinal end of said second contact stem and having an outer diameter no greater than the inner diameter of said second contact stem.

8. A high voltage circuit interrupter as recited in claim 7 wherein said vacuum maintaining means further comprises a cylindrical metallic vapor shield disposed about said first and second contacting portions and first means for securing said shield to said casing.

9. A high voltage circuit interrupter as recited in claim 8 wherein said first securing means comprises a recess formed about the inner pheriphery of said casing, a plurality of metallic segments of an annular metallic member disposed in and projecting radially inwardly from said recess, and radially outwardly projecting means formed in said shield both above and below said metallic segments for providing a capture region about the outer periphery of said shield and for locating and retaining said metallic segments in said capture region to mechanically secure said shield to said casing, said metallic segments being movable relative to said shield when located and retained in said capture region.

10. A high voltage circuit interrupter as recited in claim 9 further comprising an elongated metallic base disposed at said second longitudinal end of said housing and second means for securing said housing to said base.

11. A high voltage circuit interrupter as recited in claim 10 wherein said second securing means comprises an elongated spring disposed under tension about the outer periphery of said housing and interiorly of said base.

12. A high voltage circuit interrupter as recited in claim 11 wherein said housing includes a first inclined portion at said second longitudinal end and wherein said base includes a second inclined portion at a first longitudinal end thereof, said spring being wedged between and in contact with said first and second inclined portions to maintain said housing secured to said base.

13. A high voltage circuit interrupter as recited in claim 12 wherein said spring includes first and second curved portions at its first and second longitudinal ends, respectively, said first and second curved portions being interconnected to maintain said spring under tension.

14. A high voltage circuit interrupter as recited in claim 13 further comprising pressure equalization means disposed in said base and integral with said circuit interrupter for equalizing the pressure within said base with that representative of ambient conditions outside of said base.

15. A high voltage circuit interrupter as recited in claim 14 wherein said pressure equalization means comprises a flexible diaphragm having portions thereof secured and hermetically sealed to the interior of said base, said flexible diaphragm being movable interiorly of said base in response to a change in pressure, and wherein said base includes a first aperture formed therethrough for exposing said flexible diaphragm to the pressure representative of ambient conditions outside of the base.

16. A high voltage circuit interrupter as recited in claim 15 further comprising means for visually indicating the functional condition of said switch means to an observer remotely located from said circuit interrupter.

17. A high voltage circuit interrupter as recited in claim 16 wherein said visually indicating means comprises human readable indicia disposed within said base and visible through a sight glass secured in said base in alignment with a second aperture formed through said base.

18. A high voltage circuit interrupter as recited in claim 17 wherein said indicia comprise a first human readable indication of one of the two functional conditions of said switch means and a second human readable indication of the other one of the two functional conditions of said switch means, said first indication being mounted on a stationary member within said base in a position in alignment with said sight glass and said second indication being mounted on a movable member within said base.

19. A high voltage circuit interrupter as recited in claim 18 wherein said visually indicating means further comprises means for alternately moving said movable member to one of at least first and second spaced apart locations within said base, said second indication being in alignment with and readable through said sight glass when said movable member is in said first location and being out of alignment with and nonreadable through said sight glass when said movable member is in said second location.

20. A high voltage circuit interrupter as recited in claim 19 wherein the sight of said first indication through said sight glass is visually obscured by said second indication when said movable member is in said first location.

21. A high voltage circuit interrupter as recited in claim 20 further comprising solid dielectric insulation disposed within said housing between said first and second openings, said vacuum maintaining means being at least partially encapsulated within said insulation.

22. A high voltage circuit interrupter as recited in claim 21 wherein said insulation is formed from a closed-cell, solid, high dielectric foam.

* * * * *